US006333965B1

(12) United States Patent
Van Berkel

(10) Patent No.: US 6,333,965 B1
(45) Date of Patent: Dec. 25, 2001

(54) X-RAY EXAMINATION APPARATUS WITH A BRIGHTNESS CONTROL SYSTEM

(75) Inventor: Arnoldus P. L. Van Berkel, Schijndel (NL)

(73) Assignee: U. S. Philips Corporation, New York, NY (US)

( * ) Notice: Subject to any disclaimer, the term of this patent is extended or adjusted under 35 U.S.C. 154(b) by 0 days.

(21) Appl. No.: 09/539,910

(22) Filed: Mar. 30, 2000

(30) Foreign Application Priority Data

Apr. 2, 1999 (EP) ..... 99201059

(51) Int. Cl.[7] ..... H05G 1/64
(52) U.S. Cl. ..... 378/98.7; 378/110; 378/156
(58) Field of Search ..... 378/98.7, 110, 378/112, 108, 156

(56) References Cited

U.S. PATENT DOCUMENTS 4,097,741 * 6/1978 Pfeiler et al. ..... 378/97
5,664,000 * 9/1997 Van Woezik et al. ..... 378/98.7
5,675,624 * 10/1997 Relihan et al. ..... 378/98.7

FOREIGN PATENT DOCUMENTS

0496438A1 7/1992 (EP) .
0629105A1 12/1994 (EP) .

* cited by examiner

*Primary Examiner*—Robert H. Kim
(74) *Attorney, Agent, or Firm*—John F. Vodopia

(57) ABSTRACT

An X-ray examination apparatus includes an X-ray source with a brightness control signal input, an X-ray image device for providing an X-ray image of an object to be imaged, X-ray absorption means between the X-ray source and the X-ray image device, a brightness control system coupled to the X-ray image device and the brightness control signal input in order to derive a brightness control signal from the X-ray image, and a detection means which is coupled between the X-ray image device and the brightness control signal input in order to exclude a degree of detected absorption from said brightness control signal caused by the absorption means present in the X-ray image. Direct radiation and absorption means (such as filters) in the detected absorption range in a histogram of pixels of the X-ray image are automatically excluded from the brightness control which is thus improved.

7 Claims, 1 Drawing Sheet

X-RAY EXAMINATION APPARATUS WITH A BRIGHTNESS CONTROL SYSTEM

BACKGROUND OF THE INVENTION

1. Field of the Invention

The invention relates to an X-ray examination apparatus in which the influence of the X-ray filter on the adjustment of the X-ray examination apparatus is substantially mitigated.

2. Description of the Related Art

Such an X-ray examination apparatus is known from European patent application EP 0 629 105.

The known X-ray examination apparatus comprises an X-ray image intensifier and an image pick-up device. The X-ray image intensifier converts the X-ray image into an optical image. The image pick-up device derives the image signal from the optical image. The brightness control system of the known X-ray examination apparatus comprises an auxiliary photodetector which measures brightness values of a portion of the optical image. This portion is called the measuring field. The brightness control system is arranged to adjust the X-ray examination apparatus on the basis of the measured brightness values of the measuring field. In particular, the energy of the X-rays from the X-ray source is adjusted by the brightness control system. Although the measuring field of the known X-ray examination apparatus is adjustable, it has been found that it is difficult to avoid that a part of the X-ray filter is imaged in the measuring field. Brightness values in the measuring field which correspond to the X-ray filter lead to a sub-optimum adjustment of the X-ray examination apparatus.

The X-ray filter is, for example, adjusted so as to attenuate X-rays which are hardly attenuated by the object to be examined. Notably when a radiological examination of the patient's spinal column is performed, a part of the X-rays which pass through lung tissue are hardly attenuated by the lung tissue which contains a comparatively large amount of air. In such a radiological examination, the X-ray filter is positioned such that the X-rays that are directed towards the portion of the lungs of the patient are attenuated comparatively strongly by the X-ray filter and X-rays that are directed to the patient's spinal column are hardly or not at all attenuated by the X-ray filter. Accurate positioning of the X-ray filter is disclosed in European patent application EP 0 496 438. It has been found, however, that detrimental effects of the adjustment of the X-ray examination apparatus can occur despite of accurate positioning of the X-ray filter.

Citation of a reference herein, or throughout this specification, is not to construed as an admission that such reference is prior art to the Applicant's invention of the invention subsequently claimed.

SUMMARY OF THE INVENTION

It is an object of the invention to provide an X-ray examination apparatus in which the influence of the X-ray filter on the adjustment of the X-ray examination apparatus is substantially mitigated.

This object is achieved by means of an X-ray examination apparatus which includes: an X-ray source for emitting X-rays, an X-ray detector for deriving an image signal from an X-ray image, an X-ray filter which is placed between the X-ray source and the X-ray detector, and a brightness control system for adjusting the X-ray examination apparatus on the basis of the X-ray image, characterized in that the brightness control system is arranged to derive a threshold value from the energy of the X-rays and the composition of the filter, adjust the X-ray examination apparatus on the basis of a portion of the X-ray image having brightness values mainly larger than the threshold value, which threshold value represents the X-ray absorptivity of the X-ray filter.

According to the invention the brightness control system is arranged to adjust the X-ray examination apparatus on the basis of brightness values of the X-ray image that are larger than the threshold value. Brightness values which are less than the threshold value correspond to at least as strong X-ray absorption as caused by the X-ray filter. Such brightness values in the X-ray image that are less than the threshold value pertain to the X-ray filter and do not relate to image information of the object to be examined. Thus, by adjusting the X-ray examination apparatus on the basis of brightness values that are larger than the threshold, detrimental effects of the X-ray filter on the adjustment of the X-ray examination apparatus are substantially avoided. In particular, the adjustment of the X-ray examination apparatus concerns the setting of the energy of the X-rays from the X-ray source. The adjustment of the X-ray examination apparatus may also concern the setting of the gain factor of an amplifier whereto the image signal is applied. The threshold value is derived from the energy of the X-rays and from the composition of the X-ray filter. Hence, it is achieved that the threshold value takes into account the fact that the X-ray absorption by the X-ray filter is dependent on the energy of the X-rays and on the material and the thickness of the X-ray filter. Consequently, an accurate adjustment is achieved and in particular detrimental effects of the X-ray filter are avoided for various values of the X-ray energy. In particular, accurate adjustment is sustained when variations of the X-ray energy occur.

Preferably, the adjustment of the X-ray examination apparatus is performed on the basis of an average value of the brightness values larger than the threshold value. The average is notably taken over brightness values of a selected portion of the X-ray image, which brightness values also exceed the selected portion. The average value is less sensitive to noise, such as X-ray quantum noise, than the brightness values of the X-ray image. Hence, on the basis of the average value a more stable adjustment of the X-ray examination apparatus is achieved.

In a particular embodiment the X-ray detector comprises an X-ray image intensifier and an image-pick up apparatus, such as a television camera. The image intensifier derives an optical image from the X-ray image. Hence, the brightness values of the optical image correspond to brightness values of the X-ray image. Consequently, accurate adjustment of the X-ray examination apparatus is achieved on the basis of brightness values of the optical image larger than the threshold value. Portions of the optical image that pertain to the X-ray filter notably have brightness values less than the threshold value and hence are not taken into account for deriving the adjustment of the X-ray examination apparatus.

Preferably, the X-ray examination apparatus is provided with a photosensor to measure the light intensity in a selected portion of the optical image. The photosensor converts incident light into an electrical current and the photosensor generates an electrical photosensor signal that represents the light intensity in a selected portion of the optical image. For example, the photosensor signal corresponds to the average light intensity in the selected portion of the optical image. The intensity of the X-rays from the X-ray source is controlled by the electrical current applied to the X-ray source; this electrical current is often called the filament current. This filament current heats a cathode of the X-ray source which emits electrons to an anode of the X-ray source. The electrons are accelerated in the electrical field generated by a high voltage applied between the cathode and the anode. As the electrons strike the anode, X-rays are emitted, the intensity being dependent on the filament current and the energy being dependent on the high voltage. The ratio of the signal level of the photosensor signal to the filament current represents the average X-ray absorption in parts of the object to be examined relative to the X-ray absorption of portions of the X-ray filter which are imaged in the portion of the optical image at issue. The ratio of the signal level of the photosensor signal to the filament current is called the absorption ratio. At individual positions in the optical image, i.e. pixels of the optical image, the relative brightness value is the ratio of the brightness value to a reference brightness value. Preferably, the reference brightness value is the average brightness value of the selected portion. In respective pixels of the optical image the ratio of the absorption ratio to the relative brightness is independent of the average brightness of the selected portion and represents the X-ray absorption which causes the brightness value, i.e. light intensity, at the pixel at issue in the optical image. The X-ray examination apparatus according to the invention is adjusted on the basis of the portion of the optical image having ratios of the individual absorption ratios to the individual relative brightness values less than the threshold value. The brightness control signal for the X-ray source is derived preferably from this portion of the optical image.

The functions of the brightness control system are preferably performed by a suitably programmed computer. As an alternative, the brightness control system is provided with a special purpose (micro)processor which includes electronic circuits arranged to perform the functions of the brightness control system.

BRIEF DESCRIPTION OF THE DRAWING

The apparatus and method according to the invention will be elucidated further, together with their additional advantages, with reference to the appended drawing wherein similar components are denoted by means of the same reference numerals. In the drawing.

DETAILED DESCRIPTION OF THE PREFERRED EMBODIMENT

Figure 1:
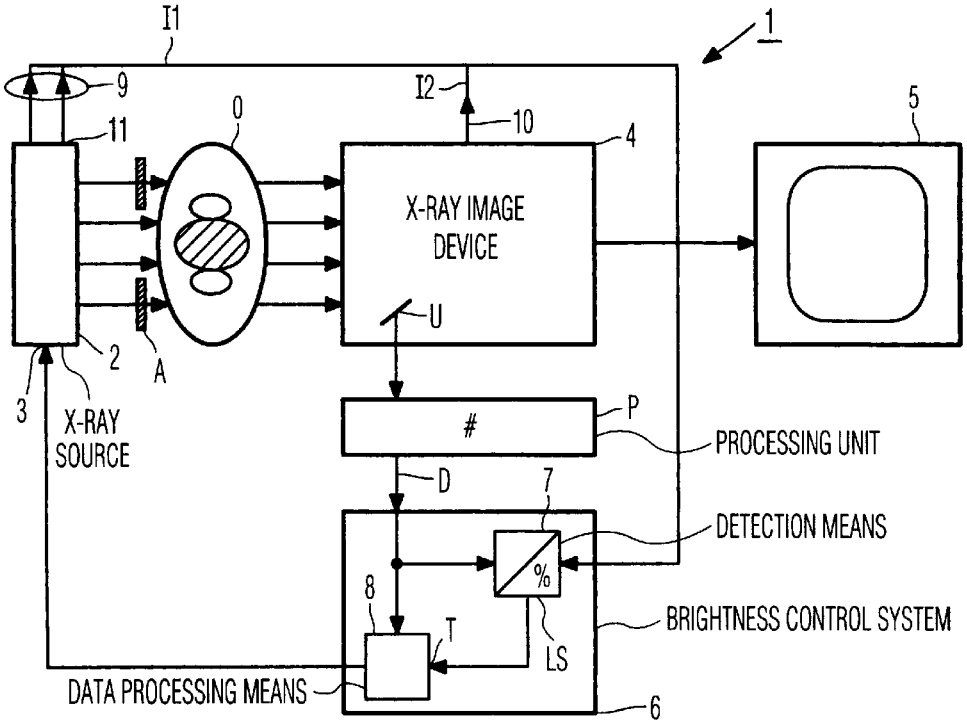
FIG. 1 shows a feasible embodiment of the X-ray examination apparatus according to the present invention.

FIG. 1 shows a schematic embodiment of an X-ray examination apparatus 1 with an X-ray source 2 having a brightness control input 3 for controlling the intensity of a beam of X-rays for irradiating an object O. Absorption or filter means A, which to some extent absorb the X-rays, are arranged generally alongside the object O in order to prevent large quantities of X-rays from being incident unabsorbed onto an X-ray image device 4 of the apparatus 1. The device 4 generally contains an (only schematically) shown image intensifier television system. The X-ray image device 4 provides a visible image on a monitors for the purpose of examination by a physician. The apparatus 1 also comprises a brightness control system 6 whereto the X-ray image is applied in the form of generally digital data D. A schematically shown deflection device U receives optical image information from the X-ray image device 4 and this image information is digitized, processed, and stored in a processing unit P; it can be retrieved therefrom so as to yield the digital data D. The digital data D represents a histogram of pixels (=picture elements) of the X-ray image which will be elucidated hereinafter with reference to FIG. 2. From the data D of the X-ray image there is derived a brightness control signal BC which is applied to the brightness control input 3.

The X-ray absorption means A in principle lower the average brightness level of the X-ray image as a whole. The brightness control then results in an overexposure of relevant parts, i.e. the object O, yielding a poor image quality. The overexposure, however, is compensated for by the brightness control system 6 as follows. The X-ray examination apparatus 1 comprises detection means 7 coupled generally between the X-ray image device 4 and the brightness control signal input 3. The detection means 7 can be included in the brightness control system 6, as exemplified in the embodiment of FIG. 1, but this is not a prerequisite. The detection means 7 are arranged to detect a measure or degree of the absorption caused by the absorption means A present in the X-ray image, which degree of detected absorption is subsequently excluded from the brightness control signal BC. An example of a absorption part excluded in a histogram of the X-ray image is depicted in the hatched area of FIG. 2.

Figure 2:
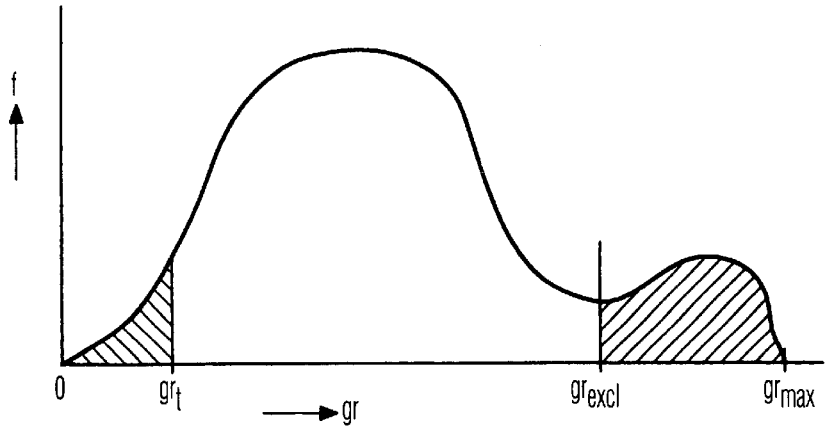
FIG. 2 shows an example of a histogram containing pixels of an X-ray image in order to illustrate the present invention.

FIG. 2 shows an example of a histogram of pixels of a visible image. This histogram shows the frequency f occurring versus all possible grey values gr from 0 (full black) to $gr_{max}$ (full white). In FIG. 2 the outer right area of the histogram elucidates the virtually unabsorbed direct radiation impinging on the X-ray image device 4. Exclusion of the hatched degree of detected absorption, caused by the absorption means, from the brightness control has the positive effect in that the brightness control will then be based exclusively on the remaining left part (not hatched) of the histogram, which left part contains relevant information about the object O to be imaged. Consequently the brightness control is optimally adapted to the object to be imaged and its absorption characteristics in order to provide an improved image quality without the aforementioned overexposure.

Referring to FIG. 1 again, the embodiment of an X-ray examination apparatus shown includes X-ray data processing means 8 which are coupled to the processing unit P, containing the histogram data of the X-ray image, and to the detection means 7 for deriving said brightness control signal from a brightness parameter defined over a range of pixels which are not excluded (not hatched in FIG. 2) in the X-ray image. Using appropriate software programming in the data processing means 8 the brightness parameter can, for example, be derived from an average, a median, or a maximum in the range of pixels in the histogram of the X-ray image.

The apparatus of FIG. 1 shows that the X-ray source 2 comprises an X-ray source data output 9 which provides output signals I1 containing information concerning the intensity and possibly the frequency of the X-ray beam irradiating the object O. The X-ray image device 4 comprises an X-ray image data output 10 which provides output signals I2 containing information concerning the intensity of the part of the X-ray beam incident on the X-ray image device 4 which was absorbed by the absorption means A. The detection means 7 are coupled to both data outputs 9 and 10 and are arranged to quantify the degree of absorption by the absorption means A.

Knowing the intensities of the beams before and after absorption, the degree or rate of absorption by the absorption means A is also known. The degree of absorption is then related to the particular histogram of the X-ray image in question in order to provide an exclusion level $gr_{excl}$, such that to the left of this exclusion level the histogram contains information which is relevant to the brightness control. The corresponding level signal is provided on an output LS of the detection means 7, which level signal is being applied to a threshold input T of the processing means 8 in order to derive the brightness control signal BC from pixels in the histogram not effected by absorption caused by the absorption means A, i.e. the pixels having a grey level above the threshold $gr_t$.

In a particular embodiment the detection means 7 are provided with schematically indicated divider means coupled to the data outputs 9 and 10, such that a current of the X-ray source 2 which represents the intensity of the beam to the object O is divided by a photodiode current which provides information on the X-ray beam intensity incident on the image means 4. The resultant quotient fed to the output LS provides a measure of the degree of absorption at a given frequency of the X-ray beam.

The output 9 can also provide X-ray source voltage information on a voltage control terminal 11, which voltage is representative of the spectral frequency range of the energy of the source beam so that the calculated degree of absorption may be corrected for the spectral frequency in order to compare absorption rates of absorption means composed of different materials at different source voltages with one another. Similar corrections can be applied whenever deemed necessary, such as correction of the aforementioned exclusion level in dependence on the image format of the image intensifier means in the X-ray image device 4 and/or correction of the exclusion level in dependence on the so called SID, being the distance between the X-ray source tube and the X-ray image means 4.

All references cited herein, as well as the priority document European Patent Application 99201059.5 filed Apr. 2, 1999, are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising:

an X-ray source for emitting X-rays, an X-ray detector for deriving an image signal from an X-ray image formed by the X-ray source, an X-ray filter which is placed between the X-ray source and the X-ray detector, and a brightness control system for adjusting the X-ray examination apparatus on the basis of the X-ray image, wherein the brightness control system is arranged to derive a threshold value from the energy of the X-rays and the composition of the filter, and adjust the X-ray examination apparatus on the basis of a portion of the X-ray image having brightness values mainly larger than the threshold value, which threshold value represents the X-ray absorptivity of the X-ray filter.

2. An X-ray examination apparatus as claimed in claim 1 wherein the brightness control system is coupled to the X-ray source so as to adjust the X-ray source on the basis of a control signal, and is further arranged to derive the control signal from the portion of the X-ray image having brightness values mainly larger than the threshold value.

3. An X-ray examination apparatus as claimed in claim 1 wherein the brightness control system is further arranged to adjust the X-ray examination apparatus on the basis of an average brightness value of the portion of the X-ray image having brightness values mainly larger than the threshold value.

4. An X-ray examination apparatus comprising:

an X-ray source for emitting X-rays, an X-ray image intensifier for deriving an optical image from an X-ray image formed by the X-ray source, an X-ray filter which is placed between the X-ray source and the X-ray image intensifier, an image pick-up system for deriving an image signal from the optical image, and a brightness control system for adjusting the X-ray examination apparatus, wherein the brightness control system is arranged to derive a threshold value from the energy of the X-rays and the composition of the filter, and adjust the X-ray examination apparatus on the basis of a portion of the optical image having brightness values mainly larger than the threshold value, which the threshold value represents the X-ray absorptivity of the X-ray filter.

5. An X-ray examination apparatus as claimed in claim 4 further comprising an electrical current supply so as to apply an electrical source current to the X-ray source, and wherein the brightness control system further comprises a photosensor to measure the light intensity of at least a portion of the optical image and to generate a photosensor signal representing the measured light intensity, and is further arranged to derive an absorption ratio equal to the ratio of the electrical source current and the signal level of the photosensor signal, derive one or more relative brightness values equal to the ratio of respective brightness values of the optical image to a reference brightness, and adjust the X-ray examination apparatus on the basis of a portion of the optical image having mainly ratios of the absorption ratio to said relative brightness values which are less than the threshold value.

6. An X-ray examination apparatus as claimed in claim 5 wherein the brightness control system is coupled to the X-ray source so as to adjust the X-ray source on the basis of a control signal, and is further arranged to derive the control signal from the portion of the X-ray image having mainly ratios of the absorption ratio to said relative brightness values which are less than the threshold value.

7. The apparatus of claim 2 wherein the brightness control system is further arranged to adjust the X-ray examination apparatus on the basis of an average brightness value of the portion of the X-ray image having brightness values mainly larger than the threshold value.

* * * * *